US005112509A

United States Patent [19]

Brink, Jr. et al.

[11] Patent Number: 5,112,509

[45] Date of Patent: May 12, 1992

[54] NON-DISPERSANT, SHEAR-STABILIZING, AND WEAR-INHIBITING VISCOSITY INDEX IMPROVER

[75] Inventors: Edward C. Brink, Jr.; Clifton C. Henderson; James R. Whiteman, all of Port Arthur, Tex.; Henry K. Sowers, Greenville, N.C.

[73] Assignee: Texaco, Inc., White Plains, N.Y.

[21] Appl. No.: 288,202

[22] Filed: Dec. 22, 1988

[51] Int. Cl.[5] ..... C10M 145/16; C10M 145/14

[52] U.S. Cl. ..... 252/56 R; 252/73; 252/79; 252/56 S; 526/219.3; 526/328.5

[58] Field of Search ..... 252/56 R, 73, 79; 526/328.5, 219.3

[56] References Cited

U.S. PATENT DOCUMENTS

| | | | |
|---|---|---|---|
| 3,033,790 | 5/1962 | Nelson | 252/56 R |
| 3,153,022 | 10/1964 | Calkins et al. | 526/328.5 |
| 3,304,260 | 2/1967 | Fields et al. | 252/56 R |
| 3,362,942 | 1/1968 | Munn | 526/328.5 |
| 3,364,182 | 1/1968 | Griffith | 526/328.5 |
| 3,637,545 | 1/1969 | Fivel | 526/328.5 |
| 3,775,356 | 11/1973 | Nagata et al. | 526/328.5 |
| 3,814,740 | 6/1974 | Miller | 526/328.5 |
| 4,493,777 | 1/1985 | Snyder, Jr. et al. | 252/79 |
| 4,533,482 | 8/1985 | Bollinger | 252/56 R |

FOREIGN PATENT DOCUMENTS

| | | | |
|---|---|---|---|
| 0633503 | 12/1961 | Canada | 252/56 R |
| 0015403 | 1/1985 | Japan | 526/219.3 |

*Primary Examiner*—Ellen McAvoy

*Attorney, Agent, or Firm*—Robert A. Kulason; James J. O'Loughlin; Vincent A. Mallare

[57] ABSTRACT

A method of making a methyl methacrylate-lauryl methacrylate copolymer for use as a non-dispersant, shear stabilizing, wear inhibiting and VI-improving additive in hydraulic fluids and lubricating oils comprises:

(a) first reacting a weight ratio of 10–20 parts methyl methacrylate to 80–90 parts lauryl methacrylate in the presence of 1.0–2.0 weight percent of an alkyl mercaptan at a temperature of 150°–200° F.;

(b) further reacting the reaction product of step (a) in the presence of 0.01–1.0 weight percent of azobis (isobutyronitrile) catalyst at a temperature of 150°–200° F.; and (c) thereafter heating the reaction product of step (b) at a temperature of 200°–300° F.

A concentrate composition comprising a base oil and an effective amount of the methyl methacrylate-lauryl methacrylate copolymer is particularly useful as an additive for use in high-VI hydraulic fluids and lubricating oils.

12 Claims, No Drawings

NON-DISPERSANT, SHEAR-STABILIZING, AND WEAR-INHIBITING VISCOSITY INDEX IMPROVER

BACKGROUND OF THE INVENTION

1. Field of the Invention

This invention relates to a method of making a methyl methacrylate-lauryl methacrylate copolymer additive for use in hydraulic fluids and lubricating oils, and to a non-dispersant, shear stabilized, and wear inhibited Viscosity Index(VI)-improving concentrate composition for use in hydraulic fluids and lubricating oils. More particularly, this invention relates to a method of making a methyl methacrylate-lauryl methacrylate copolymer additive which has non-dispersant, shear stabilizing, VI-improving and wear inhibiting properties when employed in hydraulic fluids and lubricating oils, and to a non-dispersant, shear stabilized, and wear inhibited VI-improving concentrate composition comprising a base oil and an effective amount of a methyl methacrylate-lauryl methacrylate copolymer. The concentrate of the instant invention is particularly useful when added to hydraulic fluids and lubricating oils to impart VI-improvement, shear stability, and wear inhibiting properties to such fluids and oils.

2. Information Disclosure Statement

British Pat. GB 1,172,697 (Sargent et al.) discloses a two-stage process for the preparation of an oil-soluble graft copolymer useful as a VI-improver: in the first stage a monomer mixture of up to 50 wt. % readily polymerizable, monoethylenically unsaturated monomers (e.g. styrene, n-butyl methacrylate, methyl methacrylate and mixtures thereof) and at least 50 wt. % of one or more difficultly polymerizable, monoethylenically unsaturated monomers (e.g. lauryl methacrylate) is polymerized in the presence of an oil-soluble organic peroxide or hydroperoxide catalyst; in the second stage the polymerization is continued in the presence of an azobis(diisobutyronitrile) catalyst to provide the final oil-soluble graft copolymer product. The instant invention is distinguishable from GB 1,172,697 in that it discloses a two-stage polymerization reaction in which an organic peroxide or hydroperoxide catalyst must be employed, whereas the method of formulating the copolymer of the instant invention does not employ such a catalyst. Furthermore, the concentrate of the instant invention imparts shear stabilizing and wear inhibiting properties, whereas there is no discussion of such properties in GB 1,172,697.

U.S. Pat. No. 3,252,949 (Fields et al.) discloses the preparation and use of highly syndiotactic methacrylate polymers and copolymers (e.g. methyl methacrylate-lauryl methacrylate copolymers) as VI-improvers in mineral oils and functional fluids. The highly syndiotactic polymer-copolymers of U.S. Pat. No. 3,252,949 are formulated at 0° C. using triethylboron as a catalyst, and thus are distinguishable from the copolymer of the instant invention, which is formulated at higher temperatures in the presence of an alkyl mercaptan and an azobis (isobutyronitrile) catalyst. In addition, U.S. Pat. No. 3,252,949 does not disclose any advantage of the highly syndiotactic polymers in terms of improved shear stability or wear protection, whereas the copolymer of the instant invention provides such improved shear stability and wear protection.

European Patent No. 225,598 (Derwent Abstract 87-164844/24) discloses highly shear stable and VI-improved lubricating oils comprising: (a) esters of methacrylic acid or other acids with straight chain unbranched $C_6$–$C_{15}$ alcohols; (b) esters of methacrylic acid or other acids with straight chain, unbranched $C_{16}$–$C_{30}$ alcohols; (c) esters of methacrylic or other acids with $C_8$–$C_{40}$ branched alcohols; (d) esters of methacrylic acid or other acids with $C_1$–$C_7$ alcohols; and (e) monomers copolymerizable by free radicals.

European Patent No. 164,807 (API Abstract 86-20502) discloses a multi-functional VI-improving additive for use in lubricating oils which is a graft copolymer with a molecular weight of 50,000–600,000 comprising: (a) a base copolymer of a $C_1$–$C_4$ alkyl methacrylate and a $C_{10}$–$C_{18}$ alkyl methacrylate; and (b) grafted monomers comprising at least one N-vinylimidazole, N-vinylpyrrolidone, vinyl pyridine of N, N- and dimethyl amino-ethyl methacrylate, and at least one compound of the formula $$CH_2{=}C(CH_3)CO(OCH_2CH_2)_nNHR$$

where R is a $C_1$–$C_{18}$ alkyl group. The additive is a VI-improver with dispersancy, detergency anti-wear, corrosion-inhibiting, and pour point-lowering characteristics.

European Patent No. 153,209 (API Abstract 85-22608) discloses a VI-improving and pour point-reducing additive for use in lubricating oils. The additive is a methacrylate terpolymer obtained by copolymerization of a mixture of: (a) $C_{12}$–$C_{20}$ alkyl methacrylates; (b) $C_4$–$C_{10}$ alkyl methacrylates; and (c) methyl methacrylate.

Polish Patent 124,235 (API Abstract 85-21855) discloses the preparation and use of a methacrylate-styrene copolymer as a pour point depressant and VI-improver in lubricating oils. The copolymer is obtained by reacting petrolatum, styrene, methyl methacrylate, a $C_{10}$–$C_{22}$ alkyl methacrylates, and AIBN.

European Patent No. 151,467 (API Abstract 85-22491) discloses an aqueous functional fluid useful as a hydraulic or metal working fluid, including a lubricant or anti-corrosion liquid containing a copolymer additive prepared by reacting: (a) mono or dicarboxylic acids or their half esters with aliphatic $C_1$–$C_8$ alcohols (e.g. methacrylic acid); (b) an unsaturated ester surfactant; (c) a methacrylic ester of an aliphatic $C_1$–$C_{18}$ alcohol; (d) an ethylenically unsaturated comonomer; (e) compounds with multiple ethylenic unsaturation, (e.g. divinylbenzene); and (f) a regulator (e.g. dodecylmercaptan).

U.S. Pat. No. 4,493,777 (Snyder, Jr. et al.) discloses a substantially oil-free hydraulic or metal working fluid which exhibits good shear stability and wear protection due to the presence of a copolymer comprising the reaction product of: (a) at least one ethylenically unsaturated water-soluble monomer (e.g. methacrylic acid); (b) an ethylenically unsaturated water-insoluble monomer (e.g. lauryl or methyl methacrylate); and (c) a polyvinyl cross-linking monomer.

U.S. Pat. No. 4,469,611 (Snyder, Jr. et al.) discloses a substantially oil-free aqueous industrial fluid with superior lubricating and wear preventing characteristics comprising a water-soluble synthetic addition copolymer of: (a) an ethylenically unsaturated polyalkyleneoxy-containing monomer (preferably the acrylic/-methacrylic acid ester of a nonionic surfactant alcohol); (b) an ethylenically unsaturated water-soluble monomer (e.g. methacrylic acid); and (c) an ethylenically unsaturated water-insoluble monomer (e.g. lauryl or methyl methacrylate).

U.S. Pat. No. 4,462,920 (Snyder, Jr. et al.) discloses a substantially oil-free aqueous industrial fluid with superior lubricating and wear preventing characteristics useful as hydraulic and metal working fluids comprising a water-soluble synthetic addition polymer of: (a) an ethylenically unsaturated polyvinyl cross-linking monomer; (b) an ethylenically unsaturated water-soluble monomer (e.g. methacrylic acid); (c) an ethylenically unsaturated water-insoluble monomer (e.g. lauryl or methyl methacrylate); and (d) an ethylenically unsaturated polyalkyleneoxy-containing monomer.

SUMMARY OF THE INVENTION

The instant invention relates to a method of making a methyl methacrylate-lauryl methacrylate copolymer additive for use in hydraulic fluids and lubricating oils, and to a non-dispersant, shear stabilized, wear inhibited and VI-improving concentrate composition comprising a base oil and an effective amount of a methyl methacrylate-lauryl methacrylate copolymer. The copolymer is prepared by:

(a) first reacting a weight ratio of 10–20 parts methyl methacrylate to 80–90 parts lauryl methacrylate in the presence of 1.0–2.0 weight percent of an alkyl mercaptan at a temperature of 150°–200° F.;

(b) further reacting the reaction product of step (a) in the presence of 0.01–1.0 weight percent of azobis-(isobutyronitrile) catalyst at a temperature of 150°–200° F; and (c) thereafter heating the reaction product of step (b) at a temperature of 200°–300° F.

The concentrate composition of the instant invention is particularly useful as an additive for use in high-VI hydraulic fluids and lubricating oils.

DETAILED EMBODIMENTS OF THE INVENTION

It is one object of this invention o provide a method of making a methyl methacrylate-lauryl methacrylate copolymer additive for use in hydraulic fluids and lubricating oils. It is another object of this invention to provide an oil-soluble, non-dispersant, shear stabilized, wear inhibited and VI-improving concentrate composition comprising the prescribed methyl methacrylate-lauryl methacrylate copolymer. It is yet another object of this invention to provide for the use of such a concentrate composition in hydraulic fluid and lubricant oil compositions.

It is one feature of this invention that it provides an oil-soluble, non-dispersant, VI-improving, and shear stabilized concentrate composition. It is another feature of this invention that the use of the concentrate composition in hydraulic fluids and lubricant oils yields VI-improved, shear stabilized, and wear inhibited hydraulic fluids and lubricant oils.

The instant invention is advantageous in that it provides a non-dispersant concentrate composition which exhibits enhanced VI-improvement, shear stability and wear inhibition as compared with commercially available concentrate compositions. The instant invention is particularly useful as an oil soluble non-dispersant, shear-stabilizing, wear-inhibiting VI-improver in hydraulic fluids and lubricating oils.

The concentrate composition of the instant invention comprises a base oil and an effective amount of a methyl methacrylate-lauryl methacrylate copolymer. The methyl methacrylate-lauryl methacrylate copolymer is prepared by first reacting a weight ratio of 10–20 parts, preferably 10–15 parts, most preferably 12 parts methyl methacrylate monomer to 80–90 parts, preferably 85–90 parts, most preferably 88 parts lauryl methacrylate monomer in the presence of 1.0–2.0 wt. %, preferably 1.6 wt. % of an alkyl mercaptan, preferably lauryl mercaptan at a temperature of 150°–200° F., preferably 150°–175° F., most preferably 170° F. for a period of 0.1–5.0 hours, preferably 0.1–1.0 hours, say about 0.8 hours. Thereafter, the reaction product is further reacted in the presence of 0.01–1.0 wt. %, preferably 0.01–0.5 wt. %, most preferably about 0.15 weight percent of an azobis(isobutyronitrile) catalyst at a temperature of 150°–200° F., preferably 150°–175° F., most preferably 170° F. for a period of 1–10 hours, preferably 1–5 hours, say about 4 hours. In the final step, the abovedescribed reaction product is heated to a temperature of 200°–300° F., preferably 225°–275° F., most preferably about 250° F. for a period of 0.1–5 hours, preferably 1–3 hours, say about 2 hours. The reactor concentrate batches are prepared at 90–99 wt. %, preferably 95–99 wt. %, say 97 wt. % monomers basis charge; very little polymerization solvent is necessary due to the very low molecular weight of the polymer product.

Preferred base oils for use with the abovedescribed methyl methacrylate-lauryl methacrylate copolymer include one or more paraffinic Solvent Neutral Oils such as SNO-100, having a VI of ca 97 and a viscosity of 20.01 CSt at 40° C. and 4.03 at 100° C. and SNO-335, having a VI of ca 96 and a viscosity of 62.7 CSt at 40° C. and 8.15 at 100° C. The base oil is preferably employed in admixture with the copolymer in a concentration of 25–75 wt. %, preferably 40–50 wt. %, say 48.5 wt. % (basis product). A preferred embodiment of preparing the methyl methacrylate-lauryl methacrylate copolymer is set forth in Example 1 below.

EXAMPLE 1

A weight ratio of 12 parts methyl methacrylate to 88 parts lauryl methacrylate and 1.6 parts of lauryl mercaptan were charged to a polymerization reactor, heated to 170° F. over a 0.8 hour period while purging the reactor with pre-purified nitrogen. The reactor was then charged with 0.15 wt. % Vazo initiator (azobis-(isobutyronitrile)) slurried in a polymerization solvent, and reacted for four hours at 170° F. The reaction was finished by heating the mixture to 250° F. over a two hour period. The final reaction product was thereafter mixed with 48.5 wt. % (basis product) of SNO-100 solvent neutral oil to formulate the concentrate composition of the instant invention.

The concentrate composition of the instant invention is useful as an additive for formulating shear stable, wear inhibited and VI-improved hydraulic fluids and lubricating oils such as crankcase oils and other industrial lubricants. The concentrate is particularly useful in formulating high VI hydraulic fluids which exhibit good shear stability and wear inhibition. Shear stability is advantageous in systems where the lubricant oil or hydraulic fluid is subjected to shearing forces which can deform or decompose polymer molecules used in some commercial VI improvers. High VI fluids and oils containing non-shear-stable VI improvers can be rapidly degraded to standard VI fluids and oils after undergoing mechanical shear stress. Shear stability is especially important in hydraulic fluids because hydraulic system pumps typically operate at very high speeds and pressures that subject the fluid to large mechanical shear forces.

High VI hydraulic fluids are particularly advantageous in hydraulic systems subject to wide temperature variations since high VI fluids show significantly less change in viscosity with temperature than standard VI grade fluids. At low temperatures, high VI fluids typically exhibit the excellent flow properties of low viscosity oils, resulting in uniform coating of mechanical parts, minimal friction and lubricant "drag", and correspondingly high energy efficiency. At high temperatures, high VI fluids behave more like high viscosity grade oils, retaining sufficient "body" to prevent metal to metal contact and providing good mechanical wear protection. In some hydraulic systems (especially mobile equipment), start-up temperature may be well below 0° F. while sustained operating temperatures in excess of 170° F. may be encountered.

Typical hydraulic fluid compositions employing the concentrate of the instant invention comprise 80–99 wt. %, preferably 85–90 wt. % of the abovedescribed paraffinic solvent neutral base oil, 1.0–15.0 wt. %, preferably 10.0–15.0 wt. %, say 12.50 wt. % of the prescribed methyl methacrylate-lauryl methacrylate copolymer in a diluent oil, and 0.1–5.0 wt. %, preferably 1.0–3.0 wt. % of other additives including anti-wear, corrosion inhibiting, and other additives known to those skilled in the art.

The shear stability of a high VI hydraulic fluid comprising the concentrate composition of the instant invention and several commercial high VI hydraulic fluids were compared with the Cannon Shear Stability Test. In Table 1, Composition I is a hydraulic fluid comprising the concentrate of the instant invention in a concentration of 12.50 wt. %, and Compositions II, III, IV and V are commercial hydraulic fluids.

TABLE 1

HIGH VI HYDRAULIC FLUID SHEAR STABILITY COMPARISON*
(CANNON SHEAR STABILITY TESTER)

| Hydraulic Fluid | I | II | III | IV | V |
|---|---|---|---|---|---|
| Composition, wt % | | | | | |
| Base Oil | 86.40 | 95.00 | 90.00 | 93.90 | 95.90 |
| Antiwear Package | 1.10 | 1.10 | 1.10 | 1.10 | 1.10 |
| Concentrate of Instant Invention | 12.50 | — | — | — | — |
| Other VI Improvers | — | 3.90 | 8.90 | 5.00 | 3.00 |
| Base Oil Vis | 135 SUS | 150 SUS | 140 SUS | 145 SUS | 165 SUS |
| Base Blend** Vis | | | | | |
| cSt at 40° C. | 26.11 | 29.25 | 26.04 | 27.86 | 32.02 |
| cSt at 100° C. | 4.80 | 5.15 | 4.78 | 5.00 | 5.45 |
| Initial Inspection Test Data | | | | | |
| Kinematic Vis | | | | | |
| cSt at 40° C. | 35.62 | 36.44 | 35.83 | 36.85 | 36.42 |
| cSt at 100° C. | 6.55 | 6.71 | 6.55 | 6.70 | 6.72 |
| Vis Index (VI) | 140 | 143 | 139 | 140 | 143 |
| Brookfield Vis, cP at 0° F. | 1,430 | 1,493 | 1,491 | 1,548 | 1,536 |
| After Shear Test Data*** | | | | | |
| Kinematic Vis, cSt at 40° C. | 34.67 | 33.90 | 34.49 | 34.61 | 34.04 |
| % Vis Decrease, cSt at 40° C. | 2.7 | 7.0 | 3.7 | 6.1 | 6.5 |
| % Thickening Power Loss, cSt at 40° C. | 10.0 | 35.3 | 13.7 | 24.9 | 54.1 |

*Oils blended to 35 cSt at 40 C. and VI of 140.
**Includes base oil and antiwear package.
***After 24 hours shearing in Cannon Shear Stability Tester.

As set forth in Table 1, all of the hydraulic fluid compositions tested had approximately the same kinematic viscosity value at the end of the shear stability test. However, the high VI hydraulic fluid comprising the concentrate of the instant invention (Composition I) exhibited a lower % Viscosity Decrease and % Thickening Power Loss than commercial compositions II–V. Thus, high VI hydraulic fluids comprising the concentrate of the instant invention are advantageous over commercial high VI hydraulic fluids in terms of shear stability.

Table 2 below sets forth the compositions of hydraulic fluids A, B, C and D. Fluids A, B, and C are hydraulic fluids comprising the concentrate of the instant invention. Example D is a hydraulic fluid comprising 8.82 wt. % ACRYLOID 1017, which is a shear stable VI-improving composition available from Rohm & Haas.

TABLE 2

EXPERIMENTAL HIGH VI HYDRAULIC FLUIDS

| Test Fluid | A | B | C | D |
|---|---|---|---|---|
| Composition, wt %: | | | | |
| SNO 100 | 64.50 | 62.90 | 63.55 | 68.47 |
| SNO 335 | 21.70 | 23.30 | 21.39 | 21.41 |
| Conc. of Invention | 12.50 | 12.50 | 13.76 | — |
| ACRYLOID 1017 | — | — | — | 8.82 |
| DI Pkg. | 1.10 | 1.10 | 1.10 | 1.10 |
| PMA PPD | 0.20 | 0.20 | 0.20 | 0.20 |
| Surfactant (ppm) | (150) | (150) | (150) | (150) |
| | 100.00 | 100.00 | 100.00 | 100.00 |

Table 3 below sets forth a comparison of Vickers Test 35VQ25 (Vickers Test) viscosity and wear results for hydraulic fluid A (comprising the concentrate of the instant invention) and hydraulic fluid D (comprising ACRYLOID 1017). The Vickers Test may be described as follows. Fifty gallons of a hydraulic fluid is circulated through a pump test rig containing a Vickers 35VQ25A rotary vane pump cartridge for 150 hrs. at 3000 psi ±25 psi, 2375±25 rpm, and a temperature of 200°±5° F. Three pump test cartridges are used throughout the test with a new cartridge being inserted into the test rig after every 50 hours of operation. At the end of the test period, each cartridge is examined for wear, erosion, corrosion, and stain. Total weight loss of the rings from individual cartridges tested should not exceed 75 mgs and the total weight loss of all vanes should not exceed 15 mgs.

TABLE 3

VICKERS 35VQ25 PUMP TEST RESULTS

| | | | | |
|---|---|---|---|---|
| Fluid D | | | | |
| Viscosity Data | | | | |
| Inspection Time, hrs | 0 | 88[a] | 138[a] | 188[a] |
| Viscosity, cSt, 40° C. | 37.93 | 36.94 | 36.71 | 36.66 |
| Viscosity, CSt, 100° C. | 6.88 | 6.54 | 6.50 | 6.49 |
| VI | 142 | 132 | 131 | 131 |
| Vis Decrease, 100° C. (%) | — | — | — | 3.2 |
| Wear Data | | | | |
| Cartridge Number | 1 | 2 | 3 | Avg. |
| Weight Loss, mg. | | | | |
| Vanes | 4.7 | 6.0 | 3.1 | 4.6 |
| Intravanes | 0.4 | 0.6 | 0.3 | 0.4 |
| Cam Ring | 10.0 | 45.0 | 25.0 | 26.7 |
| Total | 15.1 | 51.6 | 28.4 | 35.3 |
| Fluid A | | | | |
| Viscosity Data | | | | |
| Inspection Time, hrs | 0 | 52[b] | 102[b] | 152[b] |
| Viscosity, cSt, 40° C. | 36.40 | 36.68 | 36.25 | 35.85 |
| Viscosity, cSt, 100° C. | 6.64 | 6.43 | 6.46 | 6.37 |
| VI | 140 | 128 | 132 | 130 |
| Vis Decrease 100° C. (%) | — | — | — | 1.5 |
| Wear Data | | | | |
| Cartridge Number | 1 | 2 | 3 | Avg. |
| Weight Loss, mg | | | | |
| Vanes | 3.1 | 5.5 | 1.6 | 3.4 |
| Intravanes | 0.3 | 0.3 | 0.6 | 0.4 |
| Cam Ring | 10.0 | 20.0 | 10.0 | 13.3 |
| Total | 13.4 | 25.8 | 12.1 | 17.1 |

[a]Cartridge A was voided at 38 hours due to mechanical problems. This accounts for 38 hour offset in standard inspection times of 50, 100 and 150 hours.

[b]Prior to attaining standard test conditions, pump was operated approximately 2 hours for particle count. This accounts for 2 hour offset in standard inspection times of 50, 100 and 150 hours.

As set forth in Table 3, fluid A (comprising the concentrate of the instant invention) had a viscosity decrease of 1.5% after 152 hours, whereas fluid D (comprising ACRYLOID 1017) had a viscosity decrease of 3.2% after 188 hours. Thus fluid A is advantageous over fluid D in terms of viscosity shear stability. In addition, fluid A showed improved wear resistance (smaller average total weight loss) over fluid D. Table 3 thus illustrates that a hydraulic fluid comprising the concentrate of the instant invention is superior in terms of both viscosity shear stability and wear resistance over a hydraulic fluid comprising a commercial VI-improving additive.

Table 4 below sets forth a comparison of Denison T5D-42 Vane Pump viscosity data (Denison Vane Test) for hydraulic fluids A and D. The Denison Vane Test may be described as follows. Thirty to forty-five gallons of a hydraulic fluid is circulated through a pump test rig containing a Denison T5D-42 rotary vane pump cartridge for 100 hrs. at 2500±50 psi and 2400±100 rpm. The first 60 hours of testing is conducted at a temperature of 160°±5° F. and the last 40 hours at 210°±5° F. At the end of the test period, the test cartridge (ring, vanes, and sideplates) is examined for wear, erosion, corrosion and stain. The average vane wear should not exceed 0.0015 inches.

TABLE 4

DENISON T5D-42 VANE PUMP TEST RESULTS

| | | | | |
|---|---|---|---|---|
| | Fluid D | | | |
| Inspection Time, hrs | 0 | 20 | 60 | 100 |
| Viscosity, cSt, 40° C. | 37.93 | 36.89 | 36.12 | 38.10 |
| Viscosity, cSt, 100° C. | 6.88 | 6.60 | 6.33 | 6.50 |
| VI | 142 | 135 | 126 | 123 |
| Vis Decrease, 100° C. (%) | — | — | — | 5.5 |
| | Fluid A | | | |
| Inspection Time, hrs | 0 | 20 | 60 | 100 |
| Viscosity, cSt, 40° C. | 36.40 | 35.74 | 35.32 | 35.12 |
| Viscosity, cSt, 100° C. | 6.64 | 6.47 | 6.42 | 6.33 |
| VI | 140 | 135 | 135 | 132 |
| Vis Decrease, 100° C. (%) | — | — | — | 4.7 |

As set forth in Table 4, fluid A (comprising the concentrate of the instant invention) had a viscosity decrease of 4.7% after 100 hours, whereas fluid D (comprising ACRYLOID 1017) had a viscosity decrease of 5.5% after 100 hours. Thus fluid A is advantageous over fluid D in terms of viscosity shear stability.

Table 5 below sets forth a comparison of Denison P-46 Piston Pump viscosity data (Denison Piston Test) for hydraulic fluid B (comprising the concentrate of the instant invention) and hydraulic fluid D. The Denison Piston Test may be described as follows. Thirty to forty-five gallons of a hydraulic fluid is circulated through a pump test rig containing a Denison P-46 Piston pump cartridge for 100 hrs. at 5000±50 psi and 2400±100 rpm. The first 60 hours of testing is conducted at a temperature of 160°±5° F. and the last 40 hours at 210°±5° F. At the end of the test period, the P-46 wear plate, port plate, and face plate are examined for evidence of smearing or cracking and the piston shoe is examined for fine random scratching and radial scoring.

TABLE 5

DENISON P-46 PISTON PUMP TEST RESULTS

| | | | | |
|---|---|---|---|---|
| | Fluid D | | | |
| Inspection Time, hrs | 0 | 20 | 60 | 100 |
| Viscosity, cSt, 40° C. | 37.93 | 37.51 | 37.45 | 38.13 |
| Viscosity, cSt, 100° C. | 6.88 | 6.61 | 6.60 | 6.52 |
| VI | 142 | 132 | 132 | 124 |
| Vis Decrease, 100° C. (%) | — | — | — | 5.2 |
| | Fluid B | | | |
| Inspection Time, hrs. | 0 | 20 | 60 | 100 |
| Viscosity, cSt, 40° C. | 37.20 | 36.71 | 36.80 | 36.32 |
| Viscosity, cSt, 100° C. | 6.72 | 6.56 | 6.56 | 6.52 |
| VI | 139 | 134 | 133 | 134 |
| Vis Decrease, 100° C. (%) | — | — | — | 3.0 |

As set forth in Table 5, fluid B (comprising the concentrate of the instant invention) had a viscosity decrease of 3.0% after 100 hours, whereas fluid D (comprising ACRYLOID 1017) had a viscosity decrease of 5.2% after 100 hours. Thus fluid B is advantageous over fluid D in terms of viscosity shear stability.

Table 6 below sets forth comparison of ASTM Test D2882 (incorporated herein by reference) results for hydraulic fluids A and D.

TABLE 6

ASTM D2882 TEST RESULTS

| | Fluid D | Fluid A |
|---|---|---|
| Weight Loss, mg | 17 | 56 |
| Initial Viscosity Data | | |
| Viscosity, cSt, 40° C. | 35.82 | 36.76 |
| Viscosity, cSt, 100° C. | 6.59 | 6.90 |
| VI | 141 | 150 |

TABLE 6-continued

| ASTM D2882 TEST RESULTS | Fluid D | Fluid A |
|---|---|---|
| Final Viscosity Data | | |
| Viscosity, cSt, 40° C. | 33.6, 34.0 | 34.50, 34.68 |
| Viscosity, cSt, 100° C. | 6.19, 6.21 | 6.34, 6.45 |
| VI | 134, 133 | 136, 141 |
| Viscosity Change, 100° C., % | 6.1, 5.8 | 7.4, 6.5 |
| Avg. Vis Change, 100° C., % | 5.95 | 6.95 |

As set forth in Table 6, fluid A (comprising the concentrate of the instant invention) had a higher average % viscosity change than fluid D (comprising ACRYLOID 1017). In addition, fluid A had a higher weight loss than fluid D. This would ordinarily indicate that fluid D (comprising ACRYLOID 1017) is advantageous over fluid A (comprising the concentrate of the instant invention). However, it is believed that these results may not be valid for comparison basis, as this particular test has been found problematic due to broken rotors and inability to achieve and maintain the 2000 psi specified test limit.

Lubricating oil, hydraulic fluid, and concentrate compositions of the instant invention may additionally comprise any of the additives generally employed in such compositions. Thus, compositions of the instant invention may additionally contain surfactants, anti-icing additives, corrosion inhibitors, color stabilizers, and the like.

Although this invention has been illustrated by reference to specific embodiments, it will be apparent to those skilled in the art that various changes and modifications may be made which clearly fall within the scope of this invention. There is no intention, in the use of these specific embodiments, of excluding equivalents of the features described and it is recognized that various modifications are possible within the scope of the invention claimed.

The invention claimed is:

1. A method of making a methyl methacrylate-lauryl methacrylate copolymer for use as a non-dispersant, shear-stabilizing, Viscosity Index-improving and wear inhibiting additive in hydraulic fluids and lubricating oils, said method comprising:

(a) first reacting a weight ratio of 10–20 parts methyl methacrylate to 80–90 parts lauryl methacrylate in the presence of 1.0–2.0 weight percent of an alkyl mercaptan at a temperature of 150°–200° F.;

(b) further reacting the reaction product of step (a) in the presence of 0.01–1.0 weight percent of azobis-(isobutyronitrile) catalyst at a temperature of 150°–200° F.; and (c) thereafter heating the reaction product of step (b) at a temperature of 200°–300° F.

2. A method according to claim 1, in which said weight ratio of methyl methacrylate to lauryl methacrylate is 10–15 parts methyl methacrylate to 85–90 parts lauryl methacrylate.

3. A mehod according to claim 2, in which said weight ratio of methyl methacrylate to lauryl methacrylate is 12 parts methyl methacrylate to 88 parts lauryl methacrylate.

4. A method according to claim 1, in which said alkyl mercaptan is lauryl mercaptan, present in a concentration of about 1.6 weight percent.

5. A method according to claim 1, in which said azobis(isobutyronitrile) catalyst is present in a concentration of about 0.15 weight percent.

6. A method according to claim 1, in which said lauryl methacrylate and methyl methacrylate are reacted in the presence of lauryl mercaptan at a temperature of 150° F.–170° F.

7. A method according to claim 6, in which said reaction of said lauryl methacrylate and methyl methacrylate monomers takes place at a temperature of about 170° F.

8. A method according to claim 1, in which said reaction product of step (a) is further reacted in the presence of azo(isobutyronitrile) catalyst at a temperature of 150° F.–175° F.

9. A method according to claim 8, in which said reaction product of step (a) is further reacted in the presence of azo(isobutyronitrile) catalyst takes place at a temperature of about 170° F.

10. A method according to claim 1, in which said reaction product of step (b) is further reacted at a temperature of 225°–275° F.

11. A method according to claim 10, in which said reaction product of step (b) takes place at a temperature of about 250° F.

12. A method of making a methyl-methacrylate-lauryl methacrylate copolymer for use as a non-dispersant, shear stabilizing, Viscosity Index-improving and wear-inhibiting additive in hydraulic fluids and lubricating oils, said method comprising:

(a) first reacting a weight ratio of 12 parts methyl methacrylate to 88 parts lauryl methacrylate in the presence of 1.6 weight percent of a lauryl mercaptan at a temperature of about 170° F.;

(b) further reacting the reaction product of step (a) in the presence of about 0.15 weight percent of azobis(isobutyronitrile) catalyst at a temperature of about 170° F.; and (c) thereafter heating the reaction product of step (b) at a temperature of about 250° F.

* * * * *